US005115650A

United States Patent [19]

Patrick et al.

[11] Patent Number: 5,115,650

[45] Date of Patent: May 26, 1992

[54] NON-RUN PANTYHOSE

[75] Inventors: Alvin J. Patrick, Los Angeles, Calif.; Willie H. Patrick, deceased, late of Brown Summit; James W. Patrick, administrator, Greensboro, both of N.C.

[73] Assignee: Sheer Lady International, Inc., Los Angeles, Calif.

[21] Appl. No.: 535,729

[22] Filed: Jun. 11, 1990

[51] Int. Cl.[5] ..... D04B 1/06

[52] U.S. Cl. ..... 66/169 A; 66/177; 66/178 A

[58] Field of Search ..... 66/169 A, 177, 178 A, 66/198, 202

[56] References Cited

U.S. PATENT DOCUMENTS

| | | | |
|---|---|---|---|
| 2,702,998 | 3/1955 | Purcell | 66/178 A |
| 3,106,830 | 10/1963 | Zalenski | 66/169 A X |
| 3,956,906 | 5/1976 | Cassidy, Sr. | 66/177 X |
| 4,412,433 | 11/1983 | Safrit et al. | 66/177 |
| 4,494,388 | 1/1985 | Lau et al. | 66/178 A |

FOREIGN PATENT DOCUMENTS

| | | | |
|---|---|---|---|
| 2038212 | 3/1971 | Fed. Rep. of Germany | 66/177 |
| 7009143 | 5/1971 | Netherlands | 66/169 A |
| 1380131 | 1/1975 | United Kingdom | 66/177 |

*Primary Examiner*—Werner H. Schroeder
*Assistant Examiner*—John J. Calvert
*Attorney, Agent, or Firm*—Poms, Smith, Lande & Rose

[57] ABSTRACT

A knit pattern for fabrics which will not run when the fabric is torn or snagged. The knit pattern provides non-run pantyhose when use to knit pantyhose for women. The knit pattern consists of four repeating courses. The first course alternates a face loop stitch with a tuck stitch. The second course alternates a face loop stitch with a tuck stitch, with each face loop stitch of the first course being in the same column as each tuck stitch of the third course, and each tuck stitch of the first course being in the same column as each face loop stitch of the third course. The fourth course is knit into continuous face loop stitches.

17 Claims, 3 Drawing Sheets

FIG. 1
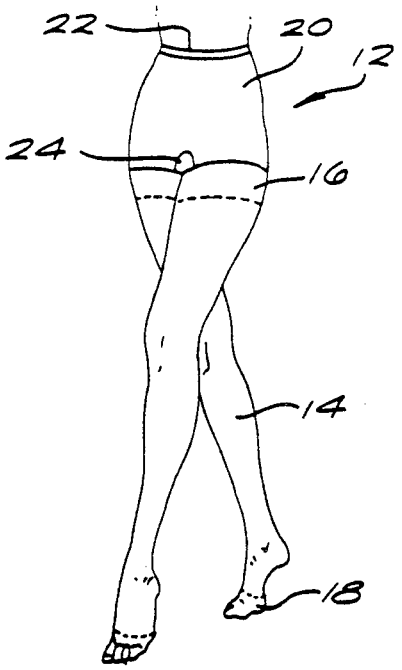
FIG. 2
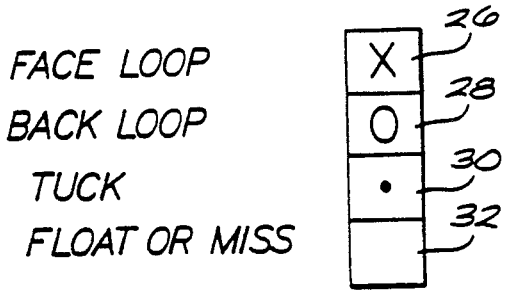
FIG. 9
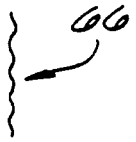
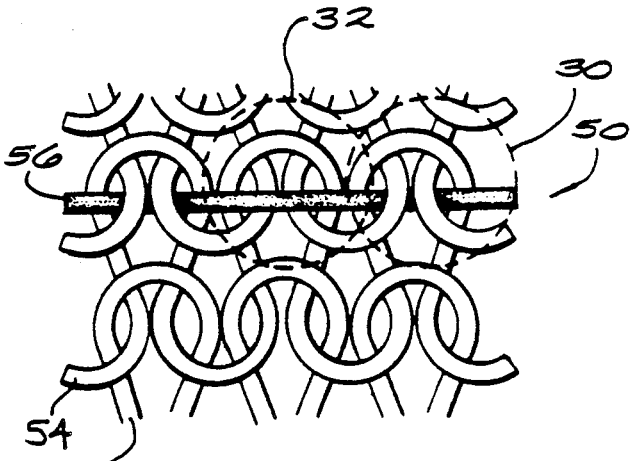
FIG. 7B
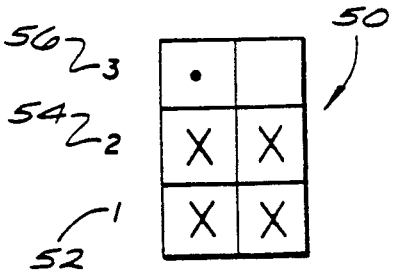
FIG. 7A FIG. 3B
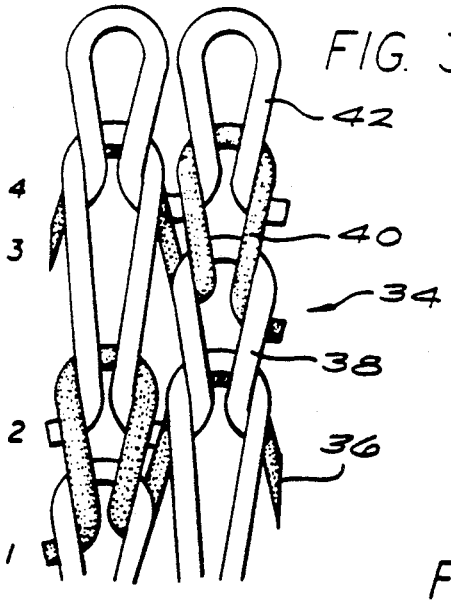
FIG. 3A
| | | | |
|---|---|---|---|
| 42 | 4 | X | X |
| 40 | 3 | • | X |
| 38 | 2 | X | X |
| 36 | 1 | X | • |
FIG. 4B
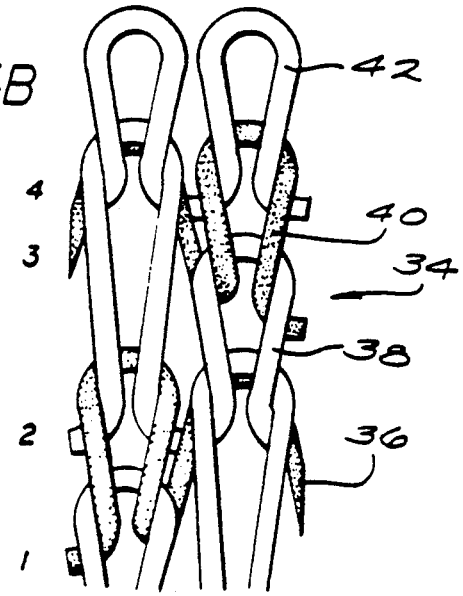
| | | | |
|---|---|---|---|
| 42 | 4 | X | X |
| 40 | 3 | • | X |
| 38 | 2 | X | X |
| 36 | 1 | X | • |
FIG. 4A
FIG. 5B
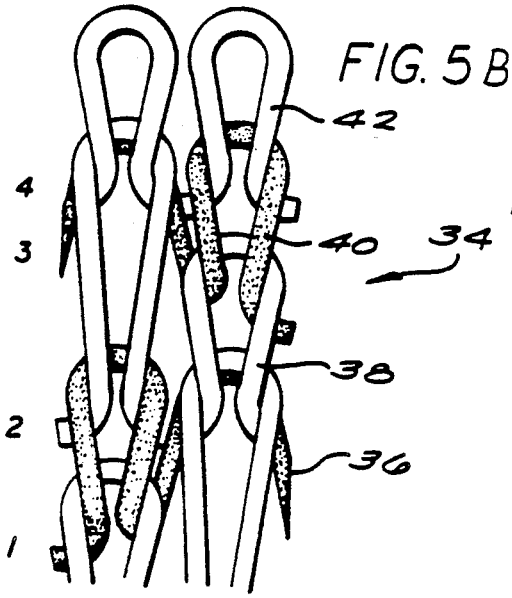
FIG. 5A
| | | | |
|---|---|---|---|
| 42 | 4 | X | X |
| 40 | 3 | • | X |
| 38 | 2 | X | X |
| 36 | 1 | X | • |

NON-RUN PANTYHOSE

FIELD OF THE INVENTION

This invention relates to a run and tear resistant weave pattern and more particularly to a run and tear resistant weave pattern suitable for use in hosiery for women.

BACKGROUND OF THE INVENTION

The problem of runs, snags and tears in pantyhose for women is well known throughout the world. The solution to the problem is especially difficult in that the problem is two-fold. The first aspect of the problem lies in the fact that nylon pantyhose have very limited elasticity. Thus, when a pair of nylon pantyhose is caught on a fingernail, piece of furniture, or any object, the nylon material does not stretch to allow the wearer time to free herself from the object, but rather, the nylon material immediately snags. The second aspect of the problem then becomes immediately apparent to the pantyhose wearer. Any type of tear or snag in the nylon material immediately results in a run in the pantyhose because the knit of the material does not allow the material to stop the run. The run in the pantyhose ruins the pantyhose. The replacement of the pantyhose each time the pantyhose are snagged is an expensive process.

Attempts have been made to overcome this expensive problem. One attempt to solve the problem resulted in the use of a thicker yarn in the knitting of the pantyhose. However, the pantyhose knit from the thicker yarn are thick in texture and dull in surface finish. Furthermore, the pantyhose do not have the desired sheerness of nylon pantyhose. Other attempts to solve the problem of runs in pantyhose resulted in pantyhose which do not stretch and re-conform to the shape of the leg. These pantyhose also sag after short periods of time because of their lack of elasticity.

Therefore, a need exists for pantyhose which are snag, tear and run resistant. The pantyhose must further be capable of stretching to a certain degree and reforming to the original shape. Moreover, the pantyhose must have the lustrous surface finish desired by women today.

SUMMARY OF THE INVENTION

One object of the present invention is to provide a knit pattern which resists runs in the knit material.

Another object of the present invention is to provide a knit pattern which resists runs and is suitable for use in hosiery for women.

A still further object of the invention is to provide a non-run pantyhose with increased elasticity.

Yet another object of this invention is to provide a non-run pantyhose with the capability of reforming itself to its original shape after being stretched out of shape.

A further object of the invention is to provide a non-run pantyhose with a smooth lustrous finish.

These and other objects of the present invention are achieved through the use of a unique knit pattern which does not run when the material is either cut or torn. The knit pattern utilizes certain yarn material so as to be elasticized with a lustrous finish. The knit pattern, although best suitable for hosiery for women, may also be used for any other type of textile in which the run and tear resistant features are desired.

These and other objects of the present invention Will now become apparent from a review of the drawings and the following description of the preferred embodiments.

BRIEF DESCRIPTION OF THE DRAWINGS

FIG. 1 is a perspective view of the run-resistant pantyhose of this invention on a model.

FIG. 2 is a representation of the symbols which represent the four types of stitches used in the present invention.

FIG. 3A is a symbolic representation of the knit pattern for the leg section of the pantyhose of this invention.

FIG. 3B is a detailed representation of the knit pattern used for the leg section of the pantyhose of this invention.

FIG. 4A is a symbolic representation of the knit pattern used for the thigh section of the pantyhose of this invention.

FIG. 4B is a detailed representation of the knit pattern used for the thigh section of the pantyhose of this invention.

FIG. 5A is a symbolic representation of the knit pattern used for the toe section of the pantyhose of this invention.

FIG. 5B is a detailed representation of the knit pattern used for the toe section of the pantyhose of this invention.

FIG. 7A is a symbolic representation of the knit pattern used for the waistband section of the pantyhose of this invention.

FIG. 7B is a detailed representation of the knit pattern used for the waistband section of the pantyhose of this invention.

FIG. 9 is a representation of the mechanically kinked yarn used in the present invention.

DETAILED DESCRIPTION

Figure 6B:
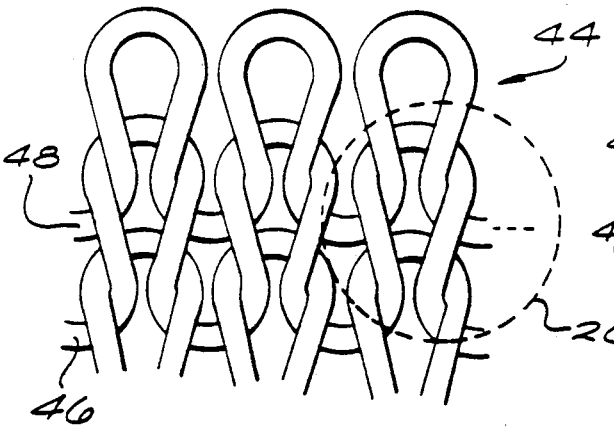
FIG. 6B is a detailed representation of the knit pattern used for the panty section of the pantyhose of this invention.

Referring now to FIG. 1, a pair of pantyhose 12 using a non-run knit pattern of the present invention is shown. As seen in FIG. 1, the pantyhose 12 may be divided into six different sections: a leg section 14, a thigh section 16, a toe section 18, a panty section 20, a waistband section 22, and a crotch section 24. In one embodiment of the pantyhose, the leg section 14, thigh section 16, and toe section 18 are run and tear resistant. This non-run feature is possible through the use of the unique knit patterns of the present invention which will be more fully described herein.

Referring now to FIG. 2, the symbolic representations for four types of stitches used in the knit patterns of the present invention are shown. As shown, a face loop stitch 26 is represented by an "X" A back loop stitch 28 is represented by an "O". A tuck stitch 30 is represented by an "·". A float stitch 32 is represented by a blank square.

Figure 8B:
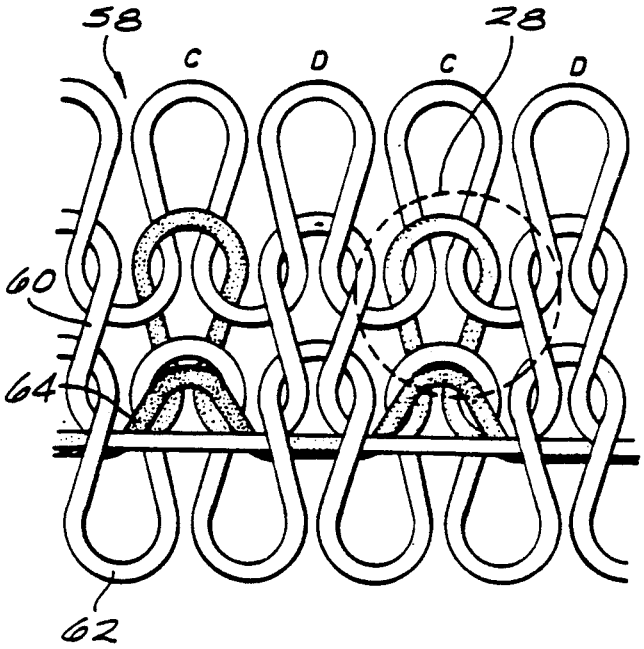
FIG. 8B is a detailed representation of the knit pattern used for the crotch section of the pantyhose of this invention.

The four types of stitches shown in FIG. 2 are known in the art. However, in order to more fully describe the present invention, a brief description of the four types of knit stitches follows. The face loop stitch 26 is an open-ended loop which loops over a loop formed in the yarn immediately above the yarn being knit. The face loop stitch 26 is best shown in detail in FIG. 6B. The back loop stitch 28 is also an open-ended loop. The back loop stitch 28, however, loops behind a loop formed in the yarn immediately above the yarn being knit. The back loop stitch 28 is best shown in FIG. 8B. The tuck stitch 30 involves interlacing the yarn being stitched behind the stitch from the yarn immediately below the yarn being knit. Therefore, the yarn being knit is tucked behind another stitch. The tuck stitch 30 is best shown in FIG. 7B. The float stitch 32 requires skipping a stitch and allowing the yarn being knit to lay over the front of the stitch from the yarn immediately below the yarn being knit. The float stitch 32 is best shown in FIG. 7B.

Referring now to FIG. 3A, a symbolic representation of the non-run knit pattern 34 is shown. FIG. 3B shows the knit pattern 34 in detail. In the symbolic representation of FIG. 3A, each yarn course is represented by a horizontal row. Thus, numbers 1 through 4 represent four separate yarn course. Each yarn course comes from a separate spool of yarn during the knitting process. Each square going across the row represents a different stitch for the yarn course. For purposes of explanation of the symbolic representations of the knit patterns only, the vertically aligned rows of stitches for the different yarn courses will be referred to as columns.

Referring again to FIG. 3A, the non-run knit pattern 34 utilizes four separate courses. Therefore, the knit pattern may be referred to as a four-yarn feed structure. A first yarn course 36 is knit with a face loop stitch 26, followed by a first tuck stitch 30. This sequence of stitches is repeated for the first yarn course 36 throughout the knit pattern 34. A second yarn course 38 is knit together with the first yarn course 36 with consecutive face loop stitches 26. A third yarn course 40 is knit together with the second yarn course 38 with a face loop stitch 26 alternating with a tuck stitches 30. This sequence of alternating stitches is followed by the third yarn course 40 throughout the knit pattern 34. However, as best shown in FIG. 3A, each of the face loop stitches of the third yarn course 40 are vertically aligned and in the same column as each of the first tuck stitches of the first yarn course 36. The unique knit pattern 34 provides the non-run feature of the present invention. If any of the yarn courses in the knit pattern 34 are cut or torn, the weave pattern allows the surrounding stitches to prevent the fabric from running.

Referring now to FIG. 3B, the knit pattern 34 is shown in detail. The knit pattern represented in FIG. 3B is preferably used in the leg section 14 of the pantyhose 12. The first and second yarn courses 36 and 40 are shown as an elastomeric yarn. Preferably, the elastomeric yarn is a Lycra material with triangular particles of nylon attached to the surface of the yarn. The use of elastomeric yarn for the first and third yarn courses 36 and 40 is an important feature in the use of the knit pattern 34 in non-run pantyhose 12. The elastomeric yarn provides an elasticized and spring effect for the pantyhose 12 Therefore, should the pantyhose 12 snag on an object, the pantyhose will stretch to a certain degree before snagging to allow the wearer to free the pantyhose from the object. This feature therefore prevents both snags, tears, and the subsequent runs in the pantyhose. The elastomeric yarn also allows the pantyhose 12 to re-conform to the shape of the leg after being stretched out of shape.

If the Lycra material is used as the elastomeric yarn, the pantyhose will be capable of stretching approximately 150% and still regain its original shape. Furthermore, the Lycra material with attached nylon particles provides a smooth and lustrous surface for the pantyhose 12. The second and fourth yarn courses 38 and 40 of the knit pattern 34 shown in FIG. 3B are preferably a nylon material.

Referring now to FIG. 4A, the symbolic representation for the knit pattern for the thigh section 16 of the pantyhose 12 is shown. FIG. 4B shows the knit pattern in detail. The knit pattern in the thigh section 16 is the same knit pattern 34 used in the leg section 14. As shown in FIG. 4B, the first and third yarn courses 36 and 40 are also preferably an elastomeric material. The second and fourth yarn courses 38 and 42 are preferably nylon material.

Figure 6A:
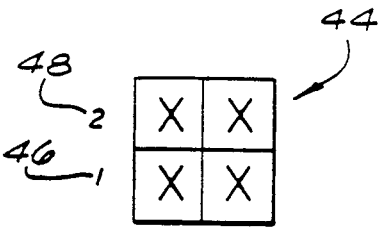
FIG. 6A is a symbolic representation of the knit pattern used for the panty section of the pantyhose of this invention.

Referring now to FIG. 5A, the symbolic representation for the knit pattern used in the toe section 18 of the pantyhose 12 is shown. FIG. 4B shows the knit pattern for the toe section 18 in greater detail. The knit pattern is the same knit pattern 34 used in the leg section 14. However, as shown in FIG. 5B, in the toe section 18 of the pantyhose 12, the first and third yarn courses 36 and 40 are preferably a coarse, non-elastomeric yarn. The second and fourth yarn courses 38 and 42 are preferably a nylon material FIG. 6A shows the symbolic representation for a knit pattern 44 for the panty section 20 of the pantyhose 12. FIG. 6B shows the knit pattern 44 for the panty section 20 in detail. The knit pattern 44 utilizes a first yarn feed 46 and a second yarn course 48. The two courses 46 and 48 are knit together with consecutive face loop stitches. As shown in FIG. 6B, the second yarn course is preferably an elastomeric material. The elastomeric material allows the fabric to stretch and reform to its original shape.

FIG. 7A shows the symbolic representation of a knit pattern 50 for the waistband section 22 of the pantyhose 12. FIG. 7B shows the knit pattern 50 in detail. The knit pattern 50 uses a first 52, a second 54, and a third 56 yarn course. The first and second yarn courses 52 and 54 are knit together in consecutive face loop stitches. The third yarn course 56 is knit together with the second yarn course 54 by alternating the tuck stitch 30 and the float stitch 32. This sequence is repeated throughout the knit pattern 50. The third yarn course 56 may be referred 15 to as an inlay yarn because it is knit throughout every second yarn course in the knit pattern 50. In the preferred embodiment of the pantyhose 12, the third yarn course 56 is an elastomeric yarn. The elastomeric yarn is preferably a Lycra material with triangular particles of nylon attached to the surface of the yarn. Several Lycra materials with nylon triangular particles commercially available may be utilized, for example, 20-11/5 Lycra DuPont (TM) yarn may be used. The third yarn course 56 therefore provides both elasticity and surface shine to the waistband section 22.

Figure 8A:
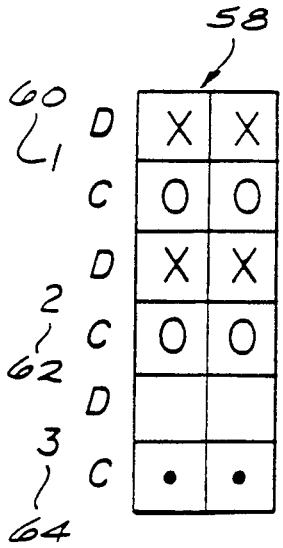
FIG. 8A is a symbolic representation of the knit pattern used for the crotch section of the pantyhose of this invention.

Referring now to FIG. 8A, a symbolic representation of the knit pattern 58 used for the crotch section 24 of the pantyhose 12 is shown. FIG. 8B shows the knit pattern 58 in detail. The knit pattern 58 is known in the art as a double-knit knit. Therefore two sets of needles are required for the weave pattern 58. The two sets of needles include a dial needle set and a cylinder needle set. The dial needle set is at a right angle with the cylinder needle during the knitting process. Therefore, the dial needle stitches vertically and the cylinder needle stitches horizontally. The use of the two sets of needles allows the fabric knit to have two faces. Therefore, in the crotch section 24, one face of the knit pattern primarily shows a cotton material and the other face primarily shows a nylon material.

FIG. 8A shows the stitches used by the dial and the cylinder needles in the knit pattern 58. The weave pattern 58 requires a first 60, a second 62, and a third 64 yarn course. The first yarn feed 60 is used by the dial needle to stitch consecutive face loop stitches and by the cylinder needle to stitch consecutive back loop stitches. The second yarn course 62 is used by the dial needle to stitch consecutive face loop stitches and by the cylinder needle to stitch consecutive back loop stitches. The third yarn course 64 is used by the dial needle to stitch consecutive float stitches and by the cylinder needle to stitch consecutive tuck stitches. Preferably, the first yarn course 60 is a cotton material. If the cotton material is used, one face of the knit pattern 58 primarily shows a cotton material.

Although the knit patterns 44, 50 and 58 are not non-run knit patterns, the patterns 44, 50 and 58 provide the features of increased strength and elasticity desired for the sections of the pantyhose 12 in which they are used.

Referring now to FIG. 9, an important feature of the present invention is shown. As shown in FIG. 9, the yarn used in the knit patterns 34, 44, 50 and 58 is mechanically kinked before knitting. A kinked yarn 66 provides for greater friction between the yarns in the knit patterns. Moreover, the kinked yarn 66 provides greater tolerance and flexibility to the knit pattern under stress. This increased friction further prevents snags and runs in the knit material.

The knit pattern 34 is also suitable for other applications besides pantyhose for women. The non-run knit pattern 34 may be used in any type of textile or for any application in which the non-run feature of the fabric is required.

Having thus described exemplary embodiments of the present invention, it should be noted by those skilled in the art that the within disclosures are exemplary only and that various other alternatives, adaptations and modifications may be made within the scope of the invention. Thus by way of example, but not of limitation, the knit pattern 34 may be used to knit all six sections of the pantyhose. Alternatively, the knit patterns may utilize varying combinations of yarn material instead of the materials specified. Furthermore, additional yarn courses may be used in the knit patterns in order to provide varying features to the knit fabric. For example, yarn courses of different colors, elasticity, or lustre may be included to add there respective features to the knit fabric. Accordingly, it is to be understood that the present invention is not limited to the precise construction as show in the drawings and described hereinabove.

We claim:

1. A method of knitting a run and tear resistant four-yarn feed structure, wherein four repeating yarn courses extend horizontally across the structure, and a plurality of columns extend vertically down the structure, comprising the steps of:

mechanically kinking the yarn in each of the yarn courses before knitting the structure;

knitting a first yarn course by repeatedly alternating a face loop stitch with a first tuck stitch, each of the stitches being in a separate column;

knitting a second yarn course into the first yarn course by a plurality of consecutive face loop stitches, each of the stitches being in a separate column;

knitting a third yarn course into the second yarn course by repeatedly alternating a second tuck stitch with a face loop stitch, each of the stitches being in a separate column, and further wherein each of the face loop stitches of the first yarn course is in the same column with each of the second tuck stitches of the third yarn course; and knitting a fourth yarn course into the third yarn course by a plurality of face loop stitches, each of the face loop stitches being in a separate column.

2. A run and tear resistant knit pattern comprising:

a first yarn curse extending horizontally across the pattern, the first yarn course being knit by repeatedly alternating one face loop stitch with a first tuck stitch, each of the face loop and the tuck stitches being in a separate vertical column;

a second yarn course extending horizontally across the pattern above the first yarn course, the second yarn course being knit into the first yarn course by a plurality of face loop stitches, each of the face loop stitches being in a separate column;

a third yarn course extending horizontally across the pattern above the second yarn course, the third yarn course being knit into the second yarn course by repeatedly alternating one face loop stitch with a second tuck stitch, each of the face loop and tuck stitches being in a separate column, and further wherein each f the face loop stitches of the third yarn course is aligned in the same column with each of the first tuck stitches of the first yarn course;

a fourth yarn course extending horizontally across the pattern above the third yarn course, the fourth yarn course being knit into the third yarn course by a plurality of face loop stitches, each of the face loop stitches being in a separate column; and wherein the first yarn course is comprised of an elastomeric Lycra material yarn with a plurality of nylon particles attached to the surface of the yarn.

3. A run and tear resistant knit pattern comprising:

a first yarn course extending horizontally across the pattern, the first yarn course being knit by repeatedly alternating one face loop stitch with a first tuck stitch, each of the face loop and the tuck stitches being in a separate vertical column;

a second yarn course extending horizontally across the pattern above the first yarn course, the second yarn course being knit into the first yarn course by a plurality of face loop stitches, each of the face loop stitches being in a separate column;

a third yarn course extending horizontally across the pattern above the second yarn course, the third yarn course being knit into the second yarn course by repeatedly alternating one face loop stitch with a second tuck stitch, each of the face loop and tuck stitches being in a separate column, and further wherein each of the face loop stitches of the third yarn course is aligned in the same column with each of the first tuck stitches of the first yarn course;

a fourth yarn course extending horizontally across the pattern above the third yarn course, the fourth yarn course being knit into the third yarn course by a plurality of face loop stitches, each of the face loop stitches being in a separate column; and wherein the third yarn course is comprised of an elastomeric Lycra material yarn with a plurality of nylon particles attached to the surface of the yarn.

4. A run and tear resistant knit pattern comprising:

a first yarn course extending horizontally across the pattern, the first yarn course being knit by repeatedly alternating one face loop stitch with a first tuck stitch, each of the face loop and the tuck stitches being in a separate vertical column;

a second yarn course extending horizontally across the pattern above the first yarn course, the second yarn course being knit into the first yarn course by a plurality of face loop stitches, each of the face loop stitches being in a separate column;

a third yarn course extending horizontally across the pattern above the second yarn course, the third yarn course being knit into the second yarn course by repeatedly alternating one face loop stitch with a second tuck stitch, each of the face loop and tuck stitches being in a separate column, and further wherein each of the face loop stitches of the third yarn course is aligned in the same column with each of the first tuck stitches of the first yarn course; and a fourth yarn course extending horizontally across the pattern above the third yarn course, the fourth yarn course being knit into the third yarn course by a plurality of face loop stitches, each of the face loop stitches being in a separate column;

and further wherein each of the yarn course is comprised of a kinked yarn.

5. A pair of run-resistant hosiery comprising:

a panty section; and two leg sections, each leg section being knit into the lower section of the panty section to form the pair of hosiery, wherein the leg sections are knit from a pattern of four horizontal yarn courses knit into vertical columns of stitches, and further wherein the four yarn courses are comprised of a first yarn course which repeatedly alternates one face loop stitch with a tuck stitch, a second yarn course knit into the first yarn course by a plurality of face loop stitches, a third yarn course which repeatedly alternates on face loop stitch with a tuck stitch, and further wherein each of the face loop stitches of the third yarn course is vertically aligned in the same column with each of the tuck stitches of the first yarn course, and a fourth yarn course knit into the third yarn course by a plurality of face loop stitches; and further wherein the first and third yarn courses are comprised of an elastomeric Lycra material yarn with a plurality of nylon particles attached to the yarn.

6. A pair of run-resistant hosiery comprising;

a panty section; and two leg sections, each leg section being knit into the lower section of the panty section to form the pair of hosiery, wherein the leg sections are knit from a pattern of four horizontal yarn courses knit into vertical columns of stitches, and further wherein the four yarn courses are comprised of a first yarn courses which repeatedly alternates one face loop stitch with a tuck stitch, a second yarn course knit into the first yarn course by a plurality of face loop stitches, a third yarn course which repeatedly alternates one face loop stitch with a tuck stitch, and further wherein each of the face loop stitches of the third yarn course is vertically aligned in the same column with each of the tuck stitches of the first yarn course, and a fourth yarn course knit into the third yarn course by a plurality of face loop stitches; and further wherein the yarn of each of the yarn courses is comprised of a kinked yarn.

7. A pair of run-resistant hosiery comprising:

a panty section; and two leg sections, each leg section being knit into the lower section of the panty section to form the pair of hosiery, wherein the leg section are knit from a pattern of four horizontal yarn courses knit into vertical columns of stitches, and further wherein the four yarn courses are comprised of a first yarn course which repeatedly alternates on face loop stitch with a tuck stitch, a second yarn course knit into the first yarn course by a plurality of face loop stitches, a third yarn course which repeatedly alternates one face loop stitch with a tuck stitch, and further wherein each of the face loop stitches of the third yarn course is vertically aligned in the same column with each of the tuck stitches of the first yarn course, and a fourth yarn course knit into the third yarn course by a plurality of face loop stitches; and further wherein each of the leg sections is further comprised of a thigh section, the thigh sections being located at the upper section of the leg section and being knit from a pattern of four horizontal yarn courses knit into vertical columns of stitches, and further wherein the four yarn courses comprise a first yarn course which repeatedly alternates one face loop stitch with a first tuck stitch, a second yarn course knit into the first yarn course by a plurality of face loop stitches, a third yarn course knit into the second yarn course and which repeatedly alternates one face loop stitch with a second tuck stitch, and further wherein each of the face loop stitches of the third yarn course is vertically aligned in the same column as each of the first tuck stitches of the first yarn course, and a fourth yarn course knit into the third yarn course by a plurality of face loop stitches; and further wherein the yarn of the first and third yarn course is comprised of an elastomeric Lycra material yarn with a plurality of nylon particles attached to the yarn.

8. A pair of run-resistant hosiery comprising:

a panty section;

two leg sections, each leg section being knit into the lower section of the panty section to form the pair of hosiery, wherein the leg sections are knit from a pattern of four horizontal yarn courses knit into vertical columns of stitches, and further wherein the four yarn courses are comprised of a first yarn course which repeatedly alternates one face loop stitch with a tuck stitch, a second yarn course knit into the first yarn course by a plurality of face loop stitches, a third yarn course which repeatedly alternates one face loop stitch with a tuck stitch, and further wherein each of the face loop stitches of the third yarn course is vertically aligned in the same column with each of the tuck stitches of the first yarn course, and a fourth yarn course knit into the third yarn course by a plurality of face loop stitches; and wherein each of the leg sections is further comprised of a thigh section ,the thigh sections being located at the upper section of the leg section and being knit form a pattern of four horizontal yarn courses knit into vertical columns of stitches, and further wherein the four yarn course comprise a first yarn course which repeatedly alternates on face loop stitch with a first tuck stitch, a second yarn course knit into the first yarn course by a plurality of face loop stitches, a third yarn course knit into the second yarn course and which repeatedly alternates one face loop stitch with a second tuck stitch, and further wherein each of the face loop stitches of the third yarn course is vertically aligned in the same column as each of the first tuck stitches of the first yarn course, and a fourth yarn course knit into the third yarn course by a plurality of face loop stitches; and further wherein the yarn of each of the yarn courses is comprised of a kinked yarn.

9. A pair of run-resistant hosiery comprising:

a panty section; and two leg sections, each leg section being knit into the lower section of the panty section to form the pair of hosiery, wherein the leg sections are knit from a pattern of four horizontal yarn courses knit into vertical columns of stitches, and further wherein the four yarn courses are comprised of a first yarn course which repeatedly alternates on face loop stitch with a tuck stitch, a second yarn course knit into the first yarn course by a plurality of face loop stitches, a third yarn course which repeatedly alternates on face loop stitch with a tuck stitch, and further wherein each of the face loop stitches of the third yarn course is vertically aligned in the same column with each of the tuck stitches of the first yarn course, and a fourth yarn course knit into the third yarn course by a plurality of face loop stitches; and further wherein each of the leg sections further comprises a separate toe section, the toe section being located at the lower section of said leg section and further being knit from a pattern of four repeating horizontal yarn courses knit into vertical columns of stitches, and further wherein the four yarn courses comprise a first yarn courses which alternates one face loop stitch with a first tuck stitch, a second yarn course knit into the first yarn course by a plurality of face loop stitches, a third yarn course knit into the second yarn course and which repeatedly alternates on face loop stitch with a second tuck stitch, and further wherein each of the face loop stitches of the third yarn course is vertically aligned with each of the first tuck stitches of the first yarn course, an a fourth yarn course knit into the third yarn course by a plurality of face loop stitches; and further wherein the yarn of each of the yarn courses is comprised of a kinked yarn.

10. A run-resistant hosiery comprising:

a panty section, wherein the panty section is knit from a panty section knit pattern of two yarn courses knit together in consecutive face loops stitches and further wherein every other yarn course of the panty section knit pattern is comprised of an elastomeric yarn; and to leg sections, each leg section being knit into the lower section of the panty section to form the pair of hosiery, wherein the leg sections are knit for ma pattern of four horizontal yarn courses knit into vertical columns of stitches, and further wherein the four yarn courses are comprised of a first yarn course which repeatedly alternates one face loop stitch with a tuck stitch, a second yarn course knit into the first yarn course by a plurality of face loop stitches, a third yarn course which repeatedly alternates one face loop stitch with a tuck stitch, and further wherein each of the face loop stitches of the third yarn course is vertically aligned in the same column with each of the tuck stitches of the first yarn course, and a fourth yarn course knit into the third yarn course by a plurality of face loop stitches.

11. A run-resistant hosiery comprising:

a panty section, wherein the panty section further comprises a waistband section knit into an upper portion of said panty section and being knit from a waistband knit pattern of three yarn courses and further wherein the three yarn courses comprise a first and a second yarn course knit together into consecutive face loop stitches and a third yarn course knit into the second yarn course in alternating tuck and float stitches; and two leg sections, each leg sections being knit into the lower section of the panty section to form the pair of hosiery, wherein the leg sections are knit from a pattern of four horizontal yarn courses knit into vertical columns of stitches, and further wherein the four yarn courses are comprised of a first yarn course which repeatedly alternates one face loop stitch with a tuck stitch, a second yarn course knit into the first yarn course by a plurality of face loop stitches, a third yarn course which repeatedly alternates one face loop stitch with a tuck stitch, and further wherein each of the face loop stitches of the third yarn course is vertically aligned in the same column with each of the tuck stitches of the first yarn course and a fourth yarn course knit into the third yarn course by a plurality of face loop stitches.

12. A run-resistant hosiery in accordance with claim 11 wherein the third yarn course is comprised of an elastomeric yarn.

13. A run-resistant hosiery in accordance with claim 12 wherein the elastomeric yarn is a Lycra material with a plurality of nylon particles attached to the surface of the yarn.

14. A run-resistant hosiery comprising:

a panty section, wherein the panty section further comprises a crotch section, the cross section being a double-knit pattern; and two leg sections, each leg section being knit into the lower section of the panty section to form the pair of hosiery, wherein the leg sections are knit from a pattern of four horizontal yarn courses knit into vertical columns of stitches, and further wherein the four yarn courses are comprised of a first yarn course which repeatedly alternates one face loop stitch with a tuck stitch, a second yarn course knit into the first yarn course by a plurality of face loop stitches, a third yarn course which repeatedly alternates one face loop stitch with a tuck stitch, and further wherein each of the face loop stitches of the third yarn course is vertically aligned in the same column with each of the tuck stitches of the first yarn course, and a fourth yarn course knit into the third yarn course by a plurality of face loop stitches.

15. A run-resistant hosiery in accordance with claim 14 wherein the double-knit pattern is knit from a first and a second set of needles, and further wherein the first and second sets of needles are disposed at a 90 degree angle to each other during the knitting process.

16. A run-resistant hosiery in accordance with claim 15 wherein the double-knit pattern uses a first, second and a third yarn course, and further wherein the first yarn courses is knit into consecutive face loops on the first needle and consecutive back loops on the second needle, the second yarn course is knit into consecutive face loops on the first needle and consecutive back loops on the second needle, and the third yarn course is knit into consecutive float stitches on the first needle and consecutive tuck stitches on the second needle.

17. A run-resistant hosiery in accordance with claim 16 wherein the first yarn course is comprised of a cotton material.

* * * * *